US008904791B2

(12) United States Patent
Lehar et al.

(10) Patent No.: US 8,904,791 B2
(45) Date of Patent: Dec. 9, 2014

(54) RANKINE CYCLE INTEGRATED WITH ORGANIC RANKINE CYCLE AND ABSORPTION CHILLER CYCLE

(75) Inventors: Matthew Alexander Lehar, München (DE); Sebastian Walter Freund, Unterfoehring (DE); Thomas Johannes Frey, Regensburg (DE); Gabor Ast, Schwaz (AT); Pierre Sebastien Huck, München (DE); Monika Muehlbauer, München (DE)

(73) Assignee: General Electric Company, Niskayuna, NY (US)

( * ) Notice: Subject to any disclaimer, the term of this patent is extended or adjusted under 35 U.S.C. 154(b) by 444 days.

(21) Appl. No.: 12/949,865

(22) Filed: Nov. 19, 2010

(65) Prior Publication Data

US 2012/0125002 A1 May 24, 2012

(51) Int. Cl.

| | |
|---|---|
| ***F01K 23/04*** | (2006.01) |
| ***F01K 25/00*** | (2006.01) |
| ***F25B 27/00*** | (2006.01) |
| ***F25B 15/00*** | (2006.01) |
| ***F01K 23/02*** | (2006.01) |
| ***F01K 25/10*** | (2006.01) |

(52) U.S. Cl.

CPC ..... *F01K 23/02* (2013.01); *F01K 25/103* (2013.01); *F01K 23/04* (2013.01)

USPC ..... 60/655; 60/671; 62/238.3; 62/476

(58) Field of Classification Search

USPC ..... 60/616, 618, 620, 641.1–641.15, 60/643–681; 62/238.3, 238.4, 476–497

See application file for complete search history.

(56) References Cited

U.S. PATENT DOCUMENTS 4,503,682 A * 3/1985 Rosenblatt ..... 60/671
4,753,077 A * 6/1988 Rosenblatt ..... 60/661

(Continued)

FOREIGN PATENT DOCUMENTS

EP 0007850 A1 2/1980
JP S61237804 A 10/1986

(Continued)

OTHER PUBLICATIONS

Chang H. Oh, Thomas Lillo, William Windes, Terry, Totemeier, Bradley Ward, Richard Moore, Robert Barner; "Development of a Supercritical Carbon Dioxide Brayton Cycle: Improving VHTR Efficiency and Testing Material Compatibility",The INL is a U.S. Department of Energy National Laboratory operated by Battelle Energy Alliance,Mar. 2006, INL/EXT-06-01271,94 Pages.

(Continued)

*Primary Examiner* — Christopher Jetton
(74) *Attorney, Agent, or Firm* — Robert M. McCarthy

(57) ABSTRACT

A power generation system is provided. The system comprises a first Rankine cycle-first working fluid circulation loop comprising a heater, an expander, a heat exchanger, a recuperator, a condenser, a pump, and a first working fluid; integrated with a) a second Rankine cycle-second working fluid circulation loop comprising a heater, an expander, a condenser, a pump, and a second working fluid comprising an organic fluid; and b) an absorption chiller cycle comprising a third working fluid circulation loop comprising an evaporator, an absorber, a pump, a desorber, a condenser, and a third working fluid comprising a refrigerant. In one embodiment, the first working fluid comprises $CO_2$. In one embodiment, the first working fluid comprises helium, air, or nitrogen.

18 Claims, 2 Drawing Sheets

(56) References Cited

U.S. PATENT DOCUMENTS

| | | | | |
|---|---|---|---|---|
| 4,765,143 | A * | 8/1988 | Crawford et al. | 60/671 |
| 5,704,209 | A | 1/1998 | Bronicki et al. | |
| 6,000,211 | A | 12/1999 | Bellac et al. | |
| 6,052,997 | A * | 4/2000 | Rosenblatt | 60/653 |
| 6,158,237 | A | 12/2000 | Riffat et al. | |
| 6,170,263 | B1 | 1/2001 | Chow et al. | |
| 6,651,443 | B1 | 11/2003 | Meckler | |
| 7,428,816 | B2 | 9/2008 | Singh et al. | |
| 2008/0168772 | A1 * | 7/2008 | Radcliff et al. | 60/651 |
| 2010/0242479 | A1 | 9/2010 | Ast et al. | |
| 2010/0263380 | A1 | 10/2010 | Biederman et al. | |

FOREIGN PATENT DOCUMENTS

WO 9524822 A2 9/1995

WO 2010016825 A2 2/2010

OTHER PUBLICATIONS

Dong Eok Kim, Moo Hwan Kim, Jae Eun Cha, Seong O Kim,"Numerical investigation on thermal-hydraulic performance of new printed circuit heat exchanger model",Nuclear Engineering and Design, Dec. 2008, vol. 238, Issue 12, pp. 3269-3276.

Jae-Eun Cha, Tae-Ho Lee, Jae-Hyuk Eon, Sung-Hwan Seong, Seong-O Kim, Dong-Eok Kim, Moo-Hwan Kim, Tae-Woo Kim, Kyun-Yul Suh,"Development of a Supercritical CO2 Brayton energy conversion system coupled with a sodium cooled fast reactor",Nuclear Engineering and Technology,2009,vol. 41, No. 8, pp. 1025-1044.

EP Search Report and Written Opinion dated Jan. 22, 2014 from corresponding Application No. 11189313.7.

* cited by examiner

RANKINE CYCLE INTEGRATED WITH ORGANIC RANKINE CYCLE AND ABSORPTION CHILLER CYCLE

BACKGROUND

The systems and techniques described herein include embodiments that relate to power generation using heat. More particularly the systems and techniques relate to power generation systems that employ a Rankine cycle integrated with an organic Rankine cycle and an absorption chiller cycle. The invention also includes embodiments that relate to use of waste heat to improve the efficiency of the power generation systems.

Performance of inert-gas closed-loop power cycles, using working fluids such as carbon dioxide ($CO_2$), helium, air, or nitrogen, may be sensitive to the reservoir temperature of a cooling medium that is employed to cool the working fluids after expansion. If atmospheric air is used as the cycle heat sink, seasonal variation in temperature may have a strong influence on the power requirement of the cycle pump or compressor, and in turn on the overall net output of the cycle.

In view of these considerations, new processes for cooling and condensing a working fluid would be welcome in the art. The new processes should also be capable of economic implementation, and should be compatible with other power generation systems.

BRIEF DESCRIPTION

In one embodiment, a power generation system is provided. The system comprises a first Rankine cycle-first working fluid circulation loop comprising a heater, an expander, a heat exchanger, a recuperator, a condenser, a pump, and a first working fluid comprising $CO_2$; integrated with, a) a second Rankine cycle-second working fluid circulation loop comprising a heater, an expander, a condenser, a pump, and a second working fluid comprising an organic fluid; and b) an absorption chiller cycle comprising a third working fluid circulation loop comprising an evaporator, an absorber, a pump, a desorber, a condenser, and a third working fluid comprising a refrigerant.

In another embodiment, a power generation system is provided. The system comprises, a first loop comprising a Rankine cycle-first working fluid circulation loop comprising a heater, an expander, a heat exchanger, a recuperator, a condenser, a pump, and a first working fluid comprising helium, nitrogen, or air; integrated with, a) a second loop comprising a Rankine cycle-second working fluid circulation loop comprising a heater, an expander, a condenser, a pump, and a second working fluid comprising an organic fluid; and b) a third loop comprising an absorption chiller cycle comprising a third working fluid circulation loop comprising an evaporator, an absorber, a pump, a desorber, a condenser, and the third working fluid comprising a refrigerant.

In yet another embodiment, a power generation system is provided. The system comprises a first loop comprising a carbon dioxide waste heat recovery Rankine cycle integrated with a) a second loop comprising an organic Rankine cycle; and b) a third loop comprising an absorption chiller cycle. The first loop comprises a heater configured to receive a first working fluid comprising liquid $CO_2$ stream and produce a heated $CO_2$ stream; an expander configured to receive the heated $CO_2$ stream and produce an expanded $CO_2$ stream, a heat exchanger configured to receive the expanded $CO_2$ stream and produce a cooler $CO_2$ stream, a recuperator configured to receive the cooled $CO_2$ stream and produce an even cooler $CO_2$ stream, a condenser configured to receive the cooled $CO_2$ stream and produce an even cooler $CO_2$ stream, a pump configured to receive the cooled $CO_2$ stream, the recuperator also capable of receiving the liquid $CO_2$ stream from the pump and produce a heated liquid $CO_2$ stream, wherein the recuperator is also capable of directing the heated liquid $CO_2$ stream back to the heater. The second loop comprises a heater configured to receive a second working fluid stream and produce a heated second working fluid stream, an expander configured to receive the heated second working fluid stream and produce an expanded second working fluid stream, a condenser configured to receive the expanded second working fluid stream and produce a cooler second working fluid stream, a pump configured to receive the cooled second working fluid stream, wherein the pump is capable of directing the cooled second working fluid stream back to the heater. The heater of the second loop is configured to receive heat from the heat exchanger of the first loop. The condenser of the first loop and the condenser of the second loop are configured to communicate heat to an absorption chiller cycle. The absorption chiller cycle is configured to communicate a portion of the heat received to an ambient environment.

In still yet another embodiment, a method of generating power is provided. The method comprises providing a first loop comprising a carbon dioxide waste heat recovery Rankine cycle; providing a second loop comprising an organic Rankine cycle; and providing a third loop comprising an absorption chiller cycle; wherein the first loop is integrated with the second loop and the third loop. The first loop comprises: a heater receiving a first working fluid comprising liquid $CO_2$ and producing a heated $CO_2$, an expander receiving the heated $CO_2$ and producing an expanded $CO_2$, a heat exchanger receiving the expanded $CO_2$ and producing a cooler $CO_2$ stream, a recuperator receiving the cooled $CO_2$ stream and producing an even cooler $CO_2$ stream, a condenser receiving the cooled $CO_2$ stream and producing a liquid $CO_2$ stream, a pump receiving the liquid $CO_2$ stream, the recuperator also capable of receiving the liquid $CO_2$ stream from the pump and producing a heated $CO_2$ stream. The recuperator is also capable of directing the heated $CO_2$ stream back to the heater. The second loop comprises: a heater receiving a second working fluid stream and producing a heated second working fluid stream, an expander receiving the heated second working fluid stream and producing an expanded second working fluid stream, a condenser receiving the expanded second working fluid stream and producing a cooler second working fluid stream, a pump receiving the cooled second working fluid stream, wherein the pump is capable of directing the cooled second working fluid stream back to the heater. The heater of the second loop receives heat from the heat exchanger of the first loop. The condenser of the first loop and the condenser of the second loop are configured to communicate heat to an absorption chiller cycle. The absorption chiller cycle is configured to communicate a portion of the heat received to an ambient environment.

BRIEF DESCRIPTION OF FIGURES

These and other features, aspects, and advantages of the present invention will become better understood when the following detailed description is read, with reference to the accompanying drawings, wherein.

DETAILED DESCRIPTION

Figure 1:
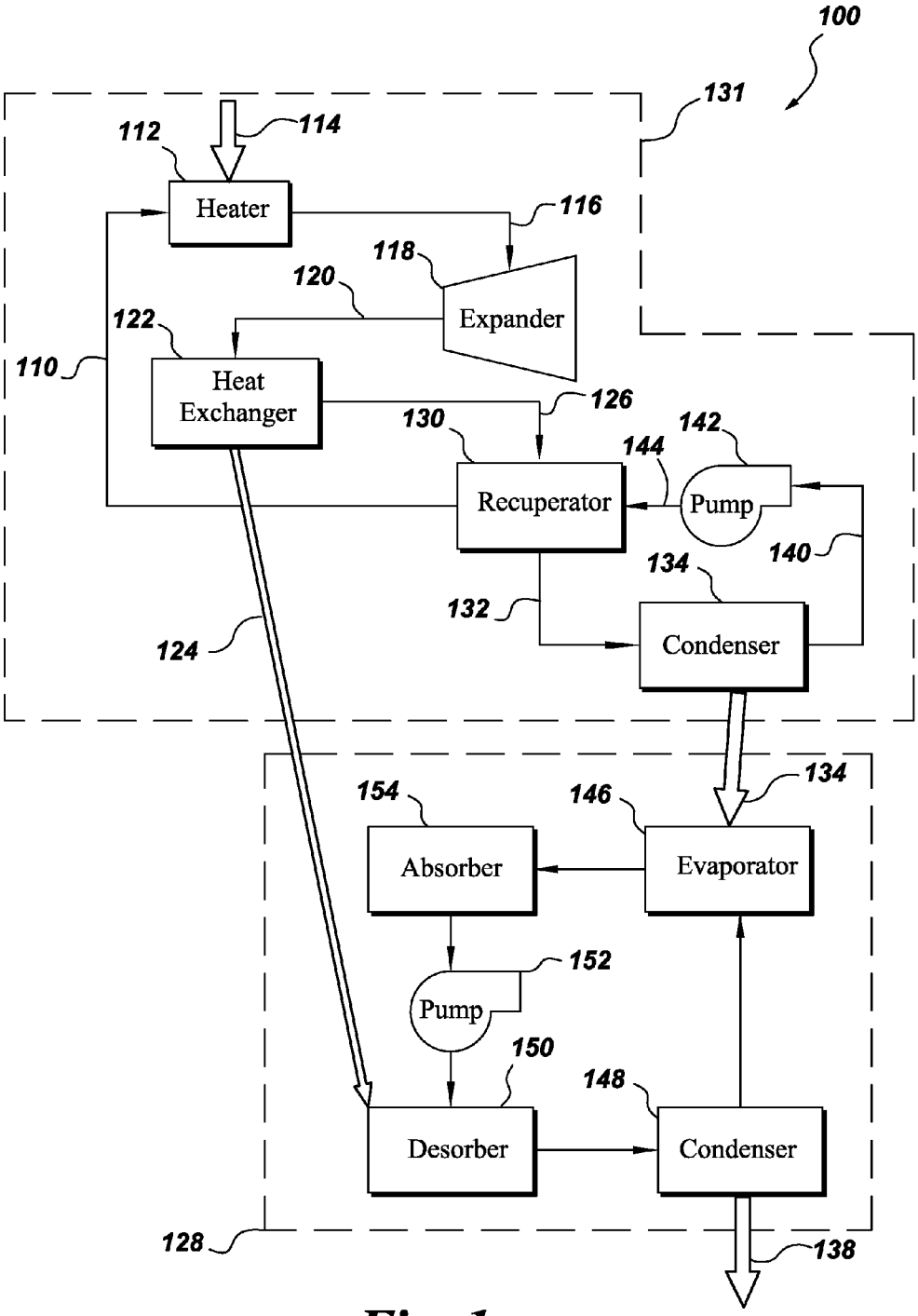
Fig. 1 (Prior Art)
FIG. 1 is a block flow diagram of a power generation system known in the art.

Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Similarly, "free" may be used in combination with a term, and may include an insubstantial number, or trace amounts, while still being considered free of the modified term.

As used herein, the terms "may" and "may be" indicate a possibility of an occurrence within a set of circumstances; a possession of a specified property, characteristic or function. These terms may also qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances, an event or capacity can be expected, while in other circumstances the event or capacity cannot occur—this distinction is captured by the terms "may" and "may be".

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," and "the," are intended to mean that there are one or more of the elements. The terms "comprising," "including," and "having" are intended to be inclusive, and mean that there may be additional elements other than the listed elements. Furthermore, the terms "first," "second," and the like, herein do not denote any order, quantity, or importance, but rather are used to distinguish one element from another.

Embodiments of the invention described herein address the noted shortcomings of the state of the art. These embodiments advantageously provide an improved power generation system. The power generation system disclosed herein can include a first loop (first power-producing element) directly exposed to a heat source and discharging heat to a third loop comprising an absorption chiller cycle. A second loop including an Organic Rankine Cycle (ORC; second power-producing element) is disposed between the first loop and the third loop in a manner such that the second loop is configured to receive waste heat from the first loop and discharge waste heat to the third loop while producing additional electric power.

As used herein, the term "waste heat" refers to heat generated in a process by way of fuel combustion or chemical reaction, which is then "dumped" into the environment and not reused for useful and economic purposes. The essential fact may not be the amount of heat, but rather its "value". The mechanism to recover the unused heat depends on the temperature of the waste heat gases and the economics involved. Large quantities of hot flue gases are generated from boilers, kilns, ovens and furnaces. If some of the waste heat could be recovered then a considerable amount of primary fuel could be saved. Though, the energy lost in waste gases may not be fully recovered, continuous efforts are being made to minimize losses.

As illustrated in FIG. 1, a power generation system 100 as known in the prior art comprises a first loop 131 which is an example of a single expansion recuperated carbon dioxide cycle for waste heat recovery integrated with a second loop 128 which is an absorption chiller cycle.

A heater 112, such as a heat recovery boiler, is configured to receive a first working fluid stream 110 and produce a heated first working fluid stream 116. The heater 112 may be heated using an external source 114, such as an exhaust gas. The stream 110 has an initial temperature as it enters the heater 112. In one embodiment, the initial temperature of the stream 110 is in a range of from about 60 degrees Celsius to about 120 degrees Celsius and the temperature of stream 116 is in a range of from about 400 degrees Celsius to about 600 degrees Celsius. An expander 118 is configured to receive the stream 116 and produce an expanded first working fluid stream 120. The temperature of the stream 120 may be less than the temperature of the stream 116 and may be greater than the stream 110. In one embodiment, the temperature of stream 120 is in a range of from about 200 degrees Celsius to about 400 degrees Celsius. The expander 118 converts the kinetic energy of the working fluid into mechanical energy, which can be used for the generation of electric power. A heat exchanger 122 is configured to receive the stream 120 and produce a cooler first working fluid stream 126. In one embodiment, the stream 126 has a temperature in a range of from about 150 degrees Celsius to about 300 degrees Celsius. The heat exchanger 122 is configured to transfer heat 124 from the expanded first working fluid stream 120 to an absorption chiller cycle 128. Heat 124 is the heat that is left in the heat exchanger 122 when the stream 120 is cooled to form the stream 126. The stream 126 may have a temperature lower than the stream 120 but higher than the stream 110.

A recuperator 130 is configured to receive the stream 126 and produce an even cooler first working fluid stream 132. In one embodiment, the temperature of stream 132 is in a range of from about 30 degrees Celsius to about 50 degrees Celsius. A condenser 134 is configured to receive the stream 132 and produce an even cooler fluid stream 140. In one embodiment, the temperature of stream 140 is in a range of from about 20 degrees Celsius to about 30 degrees Celsius. The absorption chiller cycle 128 is configured to receive the condensation heat 136 (heat left in the condenser when stream 132 is cooled to form stream 140) from the condenser 134. The absorption chiller cycle 128 cools the condenser 134 by using the heat 136 to vaporize a refrigerant. The refrigerant (not shown in figure) is the working fluid of the absorption chiller cycle 128. The absorption chiller cycle 128 is configured to discharge waste heat 138 to an ambient environment. A pump 142 is configured to receive the cooled first working fluid 140 and produce a pressurized first working fluid 144. In one embodiment, the pressure of stream 144 is in a range of about 200 bar to about 350 bar. The recuperator 130 is configured to receive the pressurized first working fluid 144 and produce the first working fluid 110 and is capable of directing the first working fluid 110 back to the heater 112 thus completing the first loop 131.

A condenser is a device or unit used to condense a substance from its gaseous state to its liquid state, typically by cooling it. The condenser of the Rankine cycle as described herein is employed to condense the first working fluid, for example, carbon dioxide to liquid carbon dioxide. In so doing, the resulting heat is given up by carbon dioxide, and transferred to a refrigerant used in the condenser for cooling the carbon dioxide. The refrigerant used in the condenser for cooling the carbon dioxide is the working fluid of the absorption chiller cycle. The refrigerant absorbs the latent heat from the carbon dioxide being cooled in the condenser, and the refrigerant is vaporized. Thus, as mentioned above, the condenser of the Rankine cycle also functions as the evaporator of the absorption chiller cycle.

As used herein, "Rankine cycle" is a cycle that converts heat into work. The heat is supplied externally to a closed loop, which usually uses water. This cycle generates most of the electric power used throughout the world. Typically, there are four processes in the Rankine cycle. In the first step, the working fluid is pumped from low pressure to high pressure. The fluid is a liquid at this stage, and the pump requires little input energy. In the second step, the high-pressure liquid enters a boiler where it is heated at constant pressure by an external heat source, so as to become a vapor. In the third step, the vapor expands through a turbine, generating power. This decreases the temperature and pressure of the vapor. In the fourth step, the vapor then enters a condenser, where it is condensed at a constant pressure, to become a saturated liquid. The process then starts again with the first step.

A recuperator is generally a counter-flow energy recovery heat exchanger that serves to recuperate, or reclaim heat from similar streams in a closed process in order to recycle it. Recuperators are used, for instance, in chemical and process industries, in various thermodynamic cycles including Rankine cycles with certain fluids, and in absorption refrigeration cycles. Suitable types of recuperators include shell and tube heat exchangers, and plate heat exchangers.

A desorber is used to remove the refrigerant from a solution, without thermally degrading the refrigerant. Suitable types of desorbers that may be employed include shell and tube heat exchangers and reboilers that may be coupled to a rectifier column.

A condenser is a heat transfer device or unit used to condense vapor into liquid. In one embodiment, the condenser employed includes shell and tube heat exchangers.

One skilled in the art will appreciate that the recuperator, condenser, and desorber described herein may include heat exchangers that may be used for the appropriate purpose. In various embodiments, the number of heaters, condensers, expanders, recuperators, etc. and the temperature and pressure of various streams used in the cycles may be determined by the power requirement from the system and the environment in which the system is being operated.

Figure 2:
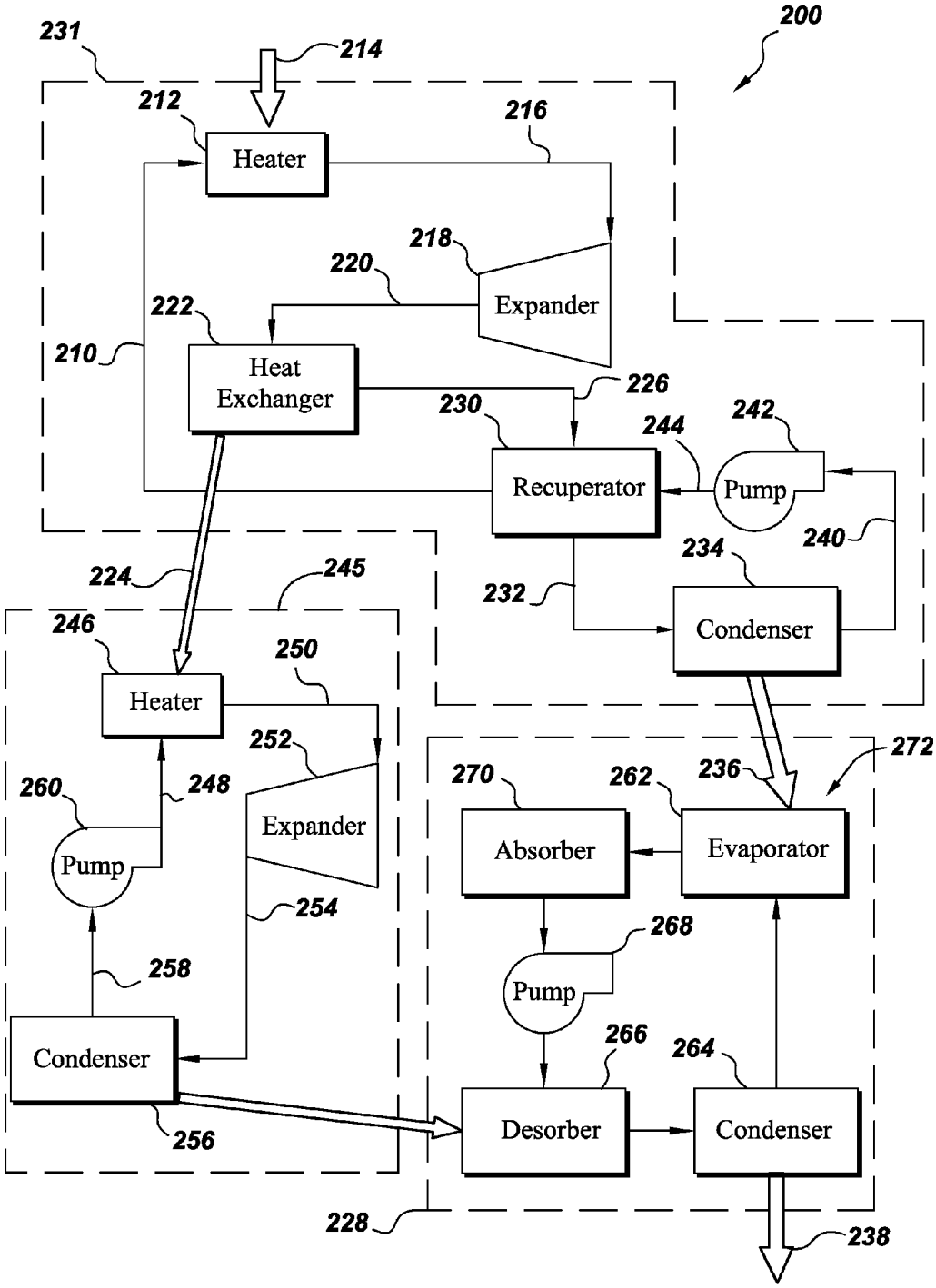
FIG. 2 is a block flow diagram of a power generation system in accordance with the embodiments of the invention.

In one embodiment, referring to FIG. 2, a power generation system is provided. The system comprises a first Rankine cycle-first working fluid circulation loop 231 comprising a heater 212, an expander 218, a heat exchanger 222, a recuperator 230, a condenser 234, a pump 242, and a first working fluid 210 comprising $CO_2$; integrated with a) a second Rankine cycle-second working fluid circulation loop 245 comprising a heater 246, an expander 252, a condenser 256, a pump 260, and a second working fluid 248 comprising an organic fluid; and b) an absorption chiller cycle 228 comprising a third working fluid circulation loop 272 comprising an evaporator, 262 an absorber 270, a pump 268, a desorber 266, a condenser 264, and a third working fluid comprising a refrigerant.

In one embodiment, the second working fluid comprises an organic fluid. Suitable examples of the organic fluid include cyclohexane, toluene and ethanol.

Suitable examples of a refrigerant that may be employed as the third working fluid include water or ammonia. In one embodiment, the absorber of the absorption chiller cycle 228 comprises a solution of the refrigerant and a solvent. The refrigerant is usually water or ammonia. The solvent is either water for the ammonia, or a lithium bromide-water solution.

In another embodiment, again referring to FIG. 2, a power generation system is provided. The system comprises a first Rankine cycle-first working fluid circulation loop 231 comprising a heater 212, an expander 218, a heat exchanger 222, a recuperator 230, a condenser 234, a pump 242, and a first working fluid 210 comprising helium, nitrogen, and air; integrated with a) a second Rankine cycle-second working fluid circulation loop 245 comprising a heater 246, an expander 252, a condenser 256, a pump 260, and a second working fluid 248 comprising an organic fluid; and b) an absorption chiller cycle 228 comprising a third working fluid circulation loop 272 comprising an evaporator 262, an absorber 270, a pump 268, a desorber 266, a condenser 264, and a third working fluid comprising a refrigerant. In one embodiment, the first working fluid is nitrogen. In another embodiment, the first working fluid is air. In yet another embodiment, the first working fluid is helium.

Referring back to FIG. 2, in one embodiment, a power generation system 200 in accordance with embodiments of the present invention is provided. The system 200 comprises a first loop 231 which is an example of a single expansion recuperated carbon dioxide cycle for waste heat recovery integrated with a second loop 245 which may be an organic Rankine cycle and a third loop 228 which may be an absorption chiller cycle.

A heater 212 such as a heat recovery boiler is configured to receive a first working fluid stream 210 and produce a heated first working fluid stream 216. In one embodiment, the first working fluid stream is carbon dioxide. In one embodiment, the first working fluid stream comprises helium, nitrogen, or air. In one embodiment, an external heat source 214 such as an exhaust gas from a combustion turbine may be employed to heat the heater 212. The stream 210 has an initial temperature as it enters the heater 212. In one embodiment, the initial temperature of the stream 210 is in a range of from about 60 degrees Celsius to about 120 degrees Celsius. In one embodiment, the stream 216 is at a temperature in a range of from about 400 degrees Celsius to about 600 degrees Celsius. An expander 218 is configured to receive the stream 216 and produce an expanded first working fluid stream 220. The temperature of the stream 220 may be less than the temperature of the stream 216 and may be greater than the stream 210. In one embodiment, the stream 220 is at a temperature in a range from about 200 degrees Celsius to about 400 degrees Celsius. The expander 218 is configured to convert the kinetic energy of the first working fluid into mechanical energy, which can be used for the generation of electric power. A heat exchanger 222 is configured to receive the stream 220 and produce a cooler first working fluid stream 226. In one embodiment, the stream 226 has a temperature in a range of from about 150 degrees Celsius to about 300 degrees Celsius. The heat exchanger 222 is also configured to transfer heat 224 to a heater 246. Heat 224 is the heat that is left in the heat exchanger 222 when the stream 220 is cooled to form the stream 226. The stream 226 may have a temperature lower than the stream 220 but higher than the stream 210.

A recuperator 230 is configured to receive the stream 226 and produce an even cooler first working fluid stream 232. In one embodiment, the stream 232 is at a temperature in a range of about 30 degrees Celsius to about 50 degrees Celsius. A condenser 234 is configured to receive the stream 232 and produce an even cooler first working fluid stream 240. In one embodiment, the temperature of stream 240 is in a range of from about 20 degrees Celsius to about 30 degrees Celsius. A pump 242 is configured to receive the stream 240 and produce a pressurized first working fluid stream 244. In one embodiment, the stream 244 has a pressure in a range of from about 200 bar to about 350 bar. The recuperator 230 is also configured to receive the stream 244 and produce the heated first working fluid stream 210. As mentioned above the recuperator 230 is capable of directing the stream 210 back to the heater 212 thus completing the first loop 231.

The heater 246 forms a part of a second loop 245 that forms an Organic Rankine Cycle. The heater 246 is configured to receive the heat 224 from the heat exchanger 222 in the first loop 231. The heater 246 is also configured to receive a second working fluid stream 248, for example an organic fluid like ethanol, cyclohexane, or toluene, and produce a heated second working fluid stream 250. In one embodiment, the stream 248 is at a temperature in a range of about 100 degrees Celsius to about 200 degrees Celsius. In one embodiment, the stream 250 has a temperature in the range of about 200 degrees Celsius to about 300 degrees Celsius. An expander 252 is configured to receive the stream 250 and produce an expanded second working fluid stream 254. As mentioned above, the expander 252 converts the kinetic energy of the second working fluid, for example ethanol, into mechanical energy, which can be used for the generation of electric power. In one embodiment, the temperature of the stream 254 is in a range of about 100 degrees Celsius to about 200 degrees Celsius. A condenser 256 is configured to receive the stream 254 and produce a cooler second working fluid stream 258. In one embodiment, the stream 258 is at a temperature in a range of from about 100 degrees Celsius to about 200 degrees Celsius. A pump 260 is configured to receive the stream 258 and to form a pressurized second working fluid stream 248. The pump 260 is configured to pump the stream 248 back to the heater 246, thus completing the loop second 245.

The condenser 234 is also configured to transfer the heat 236 to the absorption chiller 228. The condenser 256 is also configured to communicate the heat 262 from the condenser 256 to the absorption chiller cycle 228. The heat 236 and heat 262 are heat left behind in the condensers 234 and 256 respectively when streams 232 and 254 are cooled to form cooler streams 240 and 258 respectively. The absorption chiller cycle 228 is configured to use the heat 236, 262 to generate a refrigerant (not shown in figure) that is used to cool the condensers 234, 256. The absorption chiller cycle 228 is also configured to transfer the waste heat 238 (left in the absorption chiller cycle 228 after evaporating the refrigerant) at near ambient temperature (i.e., at a temperature in a range from about 20 degrees Celsius to about 30 degrees Celsius) to the ambient environment.

In one embodiment, a method of generating power is provided. Referring back to FIG. 2, a method of generating a power 200 in accordance with the embodiments of the present invention is provided. The method provides a first loop 231 which is an example of a single expansion recuperated carbon dioxide cycle for waste heat recovery integrated with a second loop 245 which may be an ORC and a third loop 228 which may be an absorption chiller cycle.

The first loop 231 comprises a heater 212 receiving a first working fluid stream 210 and producing a heated first working fluid 214. The heater 212 may comprise a heat recovery boiler. The heater 212 may be heated using an external heat source 214 such as exhaust gas from a combustion turbine. In one embodiment, the first working fluid is carbon dioxide. In another embodiment, the first working fluid comprises helium, nitrogen, or air. In one embodiment, the stream 210 is at a temperature of about 60 degrees Celsius to about 120 degrees Celsius. In one embodiment, the stream 216 is at a temperature in a range from about 400 degrees Celsius to about 500 degrees Celsius. An expander 218 is provided for receiving the stream 216 and producing an expanded first working fluid 220. The expander 218 converts the kinetic energy of the working fluid into mechanical energy, which can be used for the generation of electric power. In one embodiment, the stream 220 is at a temperature in a range of from about 200 degrees Celsius to about 400 degrees Celsius. A heat exchanger is provided for receiving the stream 220 and producing a cooler first working fluid 226. In one embodiment, the stream 226 is at a temperature in a range of from about 150 degrees Celsius to about 300 degrees Celsius. The heat exchanger 222 is also configured to transfer heat 224 to a heater 246, which forms a part of a third loop 245. Heat 224 is the heat that is left in the heat exchanger 222 when the stream 220 is cooled to form the stream 226. The stream 226 may have a temperature lower than the stream 220 but higher than the stream 210.

A recuperator 230 is provided for receiving the stream 226 and producing an even cooler first working fluid stream 232. In one embodiment, the stream 232 is at a temperature in a range of from about 30 degrees Celsius to about 60 degrees Celsius. A condenser is provided for receiving the stream 232 and producing an even cooler first working fluid stream 240. In one embodiment, the stream 240 is at a temperature in a range of from about 20 degrees Celsius to about 30 degrees Celsius.

A pump 242 is provided for receiving the stream 240 and producing a pressurized first working fluid stream 244. In one embodiment, the stream 244 has a pressure in a range of from about 200 bar to about 350 bar. The recuperator 230 receives the stream 244 and produces a heated first working fluid stream 210. The recuperator 230 is capable of directing the stream 210 back to the heater 212, thus completing the first loop 231.

The heater 246 is provided for receiving a second working fluid stream 248, for example an organic fluid like ethanol, and producing a heated second working fluid stream 250. In one embodiment, the second working fluid stream is at a temperature in a range of about 100 degrees Celsius to about 200 degrees Celsius. In one embodiment, the stream 250 is at a temperature in a range of about 200 degrees Celsius to about 300 degrees Celsius. An expander 252 is provided for receiving the stream 250 and producing an expanded second working fluid 254. As mentioned above, the expander converts the kinetic energy of the second working fluid, for example propane, into mechanical energy, which can be used for the generation of electric power. In one embodiment, the stream 254 is at a temperature in a range of about 100 degrees Celsius to about 200 degrees Celsius. A condenser 256 is provided for receiving the stream 254 and producing a cooler second working fluid stream 258. In one embodiment, the stream 258 is at a temperature in a range of about 100 degrees Celsius to about 200 degrees Celsius. A pump 260 is provided for receiving the stream 258 and producing a second working fluid 248, which is pumped back to the heater 246 to complete the loop 245.

As discussed above, the heat 236 from the condenser 234 is transferred to the absorption chiller cycle 228 and the heat 262 from the condenser 256 is transferred to an absorption chiller cycle 228. The absorption chiller cycle 228 uses heat 236 and 262 to generate a vaporized refrigerant (not shown in figure). The vaporized refrigerant is used to cool the condenser 234. The waste heat 238 at near ambient temperature (i.e., at a temperature in a range from about 20 degrees Celsius to about 30 degrees Celsius) from the absorption chiller cycle 228 is transferred to the ambient environment.

All ranges disclosed herein are inclusive of the endpoints, and the endpoints are combinable with each other. The terms "first," "second," and the like as used herein do not denote any order, quantity, or importance, but rather are used to distinguish one element from another. The use of the terms "a" and "an" and "the" and similar referents in the context of describing the invention (especially in the context of the following claims) are to be construed to cover both the singular and the plural, unless otherwise indicated herein or contradicted by context.

While the invention has been described in detail in connection with a number of embodiments, the invention is not limited to such disclosed embodiments. Rather, the invention can be modified to incorporate any number of variations, alterations, substitutions or equivalent arrangements not heretofore described, but which are commensurate with the scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A power generation system comprising:

a first Rankine cycle-first working fluid circulation loop comprising a heater, an expander, a heat exchanger, a recuperator, a condenser, a pump, and a first working fluid comprising $CO_2$;

a second Rankine cycle-second working fluid circulation loop comprising a heater, an expander, a condenser, a pump, and a second working fluid comprising an organic fluid; and an absorption chiller cycle comprising a third working fluid circulation loop comprising an evaporator, an absorber, a pump, a desorber, a condenser, and a third working fluid comprising a refrigerant, wherein the condenser of the first loop and the condenser of the second loop communicate heat to the absorption chiller cycle.

2. The power generation system of claim 1, wherein the organic fluid comprises ethanol, cyclohexane, or toluene.

3. The power generation system of claim 1, wherein the refrigerant comprises lithium-bromide or water.

4. The power generation system of claim 1, wherein the absorber comprises a solution of the refrigerant and a solvent.

5. The power generation system of claim 4, wherein the solvent comprises water or ammonia.

6. The power generation system of claim 5, wherein the absorber is cooled using air or water.

7. A power generation system comprising:

a first loop comprising a Rankine cycle-first working fluid circulation loop comprising a heater, an expander, a heat exchanger, a recuperator, a condenser, a pump, and a first working fluid comprising helium, nitrogen, or air; integrated with, a) a second loop comprising a Rankine cycle-second working fluid circulation loop comprising a heater, an expander, a condenser, a pump, and a second working fluid comprising an organic fluid; and b) a third loop comprising an absorption chiller cycle comprising a third working fluid circulation loop comprising an evaporator, an absorber, a pump, a desorber, a condenser, and the third working fluid comprising a refrigerant.

8. The power generation system of claim 7, wherein the first working fluid is nitrogen.

9. The power generation system of claim 7, wherein the first working fluid is air.

10. The power generation system of claim 7, wherein the first working fluid is helium.

11. A power generation system comprising:

a first loop comprising a carbon dioxide waste heat recovery Rankine cycle a second loop comprising an organic Rankine cycle; and a third loop comprising an absorption chiller cycle;

wherein the first loop comprises:

a heater configured to receive a first working fluid comprising liquid $CO_2$ stream and produce a heated $CO_2$ stream; an expander configured to receive the heated $CO_2$ stream and produce an expanded $CO_2$ stream, a heat exchanger configured to receive the expanded $CO_2$ stream and produce a cooler $CO_2$ stream, a recuperator configured to receive the cooled $CO_2$ stream and produce an even cooler $CO_2$ stream, a condenser configured to receive the cooled $CO_2$ stream and produce a cooler $CO_2$ stream, a pump configured to receive the cooled $CO_2$ stream, the recuperator also capable of receiving the liquid $CO_2$ stream from the pump and produce a heated liquid $CO_2$ stream, wherein the recuperator is capable of directing the heated liquid $CO_2$ stream back to the heater;

wherein the second loop comprises:

a heater configured to receive a second working fluid stream and produce a heated second working fluid stream, an expander configured to receive the heated second working fluid stream and produce an expanded second working fluid stream, a condenser configured to receive the expanded second working fluid stream and produce a cooler second working fluid stream, a pump configured to receive the cooled second working fluid stream, wherein the pump is capable of directing the cooled second working fluid stream back to the heater;

wherein the heater of the second loop is configured to receive heat from the heat exchanger of the first loop;

wherein the condenser of the first loop and the condenser of the second loop are configured to communicate heat to an absorption chiller cycle; and wherein the absorption chiller cycle is configured to communicate a portion of the heat received to an ambient environment.

12. The power generation system of claim 11, wherein the second working fluid comprises an organic fluid comprising, ethanol, cyclohexane, or toluene.

13. The power generation system of claim 11, wherein the absorption chiller cycle comprises an evaporator, an absorber; a pump, a desorber, a condenser, and a third working fluid comprising a refrigerant.

14. The power generation system of claim 13, wherein the refrigerant comprises lithium bromide or water.

15. The power generation system of claim 13, wherein the absorber comprises a solution of the refrigerant in a solvent.

16. The power generation system of claim 15, wherein the solvent comprises water or ammonia.

17. The power generation system of claim 13, wherein the absorber is cooled using air or water.

18. The power generation system of claim 11, further comprising a turbine connected to the expanders of the first loop and the second loop.

* * * * *